United States Patent [19]

Kennedy et al.

[11] 4,161,868

[45] Jul. 24, 1979

[54] REFRIGERATOR WITH FRONT ACCESS MEANS

[75] Inventors: Thomas E. Kennedy, Niles, Mich.; Thomas H. Thompson, Mishawaka, Ind.

[73] Assignee: Tyler Refrigeration Corp., Niles, Mich.

[21] Appl. No.: 862,932

[22] Filed: Dec. 21, 1977

[51] Int. Cl.[2] ..... A47F 3/04

[52] U.S. Cl. ..... 62/256; 62/252

[58] Field of Search ..... 62/256, 251, 252, 253; 312/236; 98/36

[56] References Cited

U.S. PATENT DOCUMENTS

| | | | |
|---|---|---|---|
| 2,379,885 | 7/1945 | Davis | 62/256 |
| 2,460,030 | 1/1949 | Rear | 62/256 |
| 2,492,695 | 12/1949 | Henderson | 62/252 |
| 2,635,434 | 4/1953 | Bently | 62/256 |

*Primary Examiner*—Lloyd L. King
*Attorney, Agent, or Firm*—LeBlanc & Shur

[57] ABSTRACT

A refrigerator case for supporting items for display having a front wall access to expose a well portion of the case for loading and unloading the items for display. More specifically, the refrigerator case includes a front panel hingedly secured to a front wall of the case. The panel pivots from a closed position where access is not available through the front wall to an open position where the well portion of the case is exposed through the front wall for loading and unloading items. When in the open position the inner surface of the panel is coplanar with the bottom surface of the well portion. The panel is supported in the open position by flexible cable connected to struts in the front wall. In this manner, baskets containing the items for display may be slid over the inner surface of the panel and into the well portion.

15 Claims, 4 Drawing Figures

REFRIGERATOR WITH FRONT ACCESS MEANS

BACKGROUND OF THE INVENTION

In retail establishments and particularly self-service grocery stores, large open-faced freezers are used to display frozen goods for sale and maintain the goods sufficiently refrigerated so that they will remain frozen within the freezer. In the open-top freezer, sometimes referred to as a coffin-type freezer, it has been necessary to place the goods sold through the same open face from which access is gained to the cause by the customer in picking out the goods to be purchased. Because these freezers are often quite deep, it becomes a time consuming process to remove the goods from the boxes in which they were shipped and place them piecemeal at the appropriate place within the freezer.

Another approach has been to employ large baskets having the selection of goods to be placed in the freezer. With this approach, the depleted basket is removed from the freezer through the open portion along the top. The basket full of the replacement goods is then lifted from the carrier and placed into the appropriate position in the freezer, replacing the basket just removed. As these baskets tend to be quite large, they may be usually heavy, putting unnecessary strain on the service personnel in lifting the basket in and out of the freezer.

In both of the above-discussed methods of loading and unloading a freezer, there is considerable time wasted on the part of the service personnel is replacing goods within the freezer. Particularly with regard to the use of racks having the replacement goods therein, it requires usually strong personnel to move the racks when fully loaded, from one position to another. Again, because of the selection process required to find appropriate personnel to load and unload these racks or baskets, time may be lost in replacing depleted goods in the freezer. In addition, inefficient use of various personnel may result.

Specific examples of other refrigerators using doors to remove the contents include the U.S. Pat. No. 591,401 to Harrison where there is shown a door to an icebox providing access for loading and unloading. The door forms part of a bench to support the goods displayed as well as providing a closure for the refrigerator. The bench rests on a track inside the icebox when it is utilized to support meats for display. Another track is located outside the box and is actually an extension of the interior track inside the box on which the bench typically rests. The portion of the track exterior to the box cooperates with a door and the bench to support them when the door is moved to an open position. When it is desired to remove the meats, the door is opened, creating an opening in the icebox allowing the bench to be moved to the extended portion of the track exterior of the icebox. The door is actually hingedly secured to the bench and when the bench is drawn out of the box the door is carried along and turned down to form an extension of the bench. As can be seen from FIG. 1 of the Harrison et al patent, the portion of the track exterior to the sidebox is relied upon in supporting the bench and door when the bench is moved to the position exterior the box as shown by the dashed lines. The problem with this approach is that it leaves parts of the device in the aisles, which patrons or service personnel may be using. In addition, there is an unusually large number of parts simply to remove the meat from the icebox.

Other refrigerating cases having access means to the interior portion of the refrigerator includes the U.S. Pat. No. 2,631,438 to Webber. The Webber patent discloses an open-top, self-service refrigerator display case having a plurality of closure doors hingedly mounted about a horizontal axis at the rear wall of the display case to provide accessability for changing or shifting articles on display. In the preferred embodiment as shown by Webber, the closure doors are relatively high on the display case, requiring the service personnel to lift the goods from his cart up to the top portion of the display case to refurbish the bin. The U.S. Pat. No. 2,773,362 to Sheitlin relates to an upright freezer closed by an insulated door which is hingedly mounted about the vertical axis. Inside the cabinet are located vertically-shaped freezer shelves which are each provided with a door pivoted at the front edge of the shelf from a closed vertical position to a horizontal position once the insulated door is opened. The Sheitlin approach suffers from many of the same problems discussed with respect to Harrison in that there are an unusual number of interrelated parts. For example, Sheitlin requires an insulated door in addition to several doors which pivot outwardly once the insulated door is removed. Furthermore, Sheitlin does not relate to a device where the door actually forms part of a flowpath for refrigerated air.

Other examples of horizontally pivoted doors in refrigeration apparatus include the U.S. Patents to Manshel and Dickinson et al, U.S. Pat. Nos. 2,136,558 and 2,938,363, respectively.

There have been numerous attempts in providing carts or other carriers for loading goods into a refrigerator. An example of this is the U.S. Pat. No. 2,928,262 to Litman. In this patent, there is shown, although it is not described, a rollable cart which appears to have means for supporting a plurality of vertically spaced trays or pans. These trays are apparently inserted to racks in the storage space of the disclosed refrigerator through the door openings. From the drawings, it appears that an operator would have to lift the goods from the cart into the desired shelf of the refrigerator. Other examples of the use of carts and refrigerators are shown in the U.S. Pat. No. 3,392,543 to Miller, U.S. Pat. No. 3,478,535 to Perez et al., and U.S. Pat. No. 3,690,118 to Rainwater. All of these patents relate to refrigerators and cart systems where the cart is rolled in its entirety with its goods already stocked therein into refrigerated cases replacing a cart that has been depleted by the patrons in the store.

SUMMARY OF THE INVENTION

Generally, the invention relates to a freezer for displaying frozen goods for sale in a self-service establishment and maintaining the goods within the freezer in the manner which provides access to the goods by a customer. The freezer includes a well portion, which is enclosed by several walls for containing the frozen goods for display. The top portion of the freezer is left open to provide access to the items contained in the well portion. A front wall of the freezer has access means therethrough for receiving items to be displayed in the well portion of the freezer.

More particularly, as described in the preferred embodiment hereinafter, the front wall has a panel which is hinged along the bottom portion thereof for pivotable movement away from the front wall. The panel is hinged in such a manner that the inner surface of the panel, when moved to an open position is copolanar with the bottom surface of the freezer. The panel is held in place in this open position so that it can support the weight of the replacement goods on the inner surface. In replacing the goods, a cart having a support surface which is also coplanar with the inner surfaces and bottom surfaces of the freezer is moved to a position adjacent the panel. Cartons or racks carrying the replacement goods can then be simply slid from the surface of the cart onto the inner surface of the panel through the opening resulting therefrom and ultimately onto the bottom of the freezer. Once the racks have been placed through the opening in the front wall into the desired position within the interior portion of the freezer, the panel portion is then returned to a closed position substantially sealing the interior portion of the freezer from the ambient in the area of the front wall. Each freezer includes a number of these movable panels so that various items at different positions within the freezer can be readily replaced in the manner discussed above.

Because a substantial number of items can be carried in a basket, a significant amount of time is saved in replacing depleted goods in large containers rather than a piecemeal or other such approach. In addition, because a cart is employed to carry these container items, there is not the requirement for strength as there would be otherwise if the large containers had to be lifted from a carrier and placed into the appropriate position in the freezer through the top.

It is an object of the invention described herein to provide an improved refrigerator having simplified access means which overcome the problems discussed in the background of the invention.

Another object of the invention is to achieve a refrigeration unit having an access door removably secured to the front portion of the refrigeration unit which provides easy access into and out of the interior of the unit with a minimum number of movable parts.

A further object of the invention herein is to simplify loading and unloading of a refrigeration unit, particularly the type used in a self-service store, without the need for the service personnel to lift the produce or other goods to be displayed in the refrigeration unit either into or out of the unit.

Still a further object of the invention described herein is to provide a refrigeration display unit having access means which avoids unnecessary interference with aisle space in the store allowing the patrons and service personnel to move readily throughout the store, even while the refrigeration unit is being loaded or unloaded.

Still another object of the invention described herein is to provide an access means integrated with the refrigeration system in the refrigeration unit whereby a path is provided through the door when the door is in a closed position, but the path is closed when the door is in an open position allowing the goods to be moved from a cart into the interior portion of the refrigeration unit without unnecessary loss in refrigerated air.

The above-defined objects are only a few of the objects and advantages of the invention. Other objects and advantages will become apparent in the detailed discussion of the preferred embodiment as well as the claims which follow hereinafter.

IN THE DRAWINGS

DETAILED DESCRIPTION OF THE PREFERRED EMBODIMENT

Figure 1:
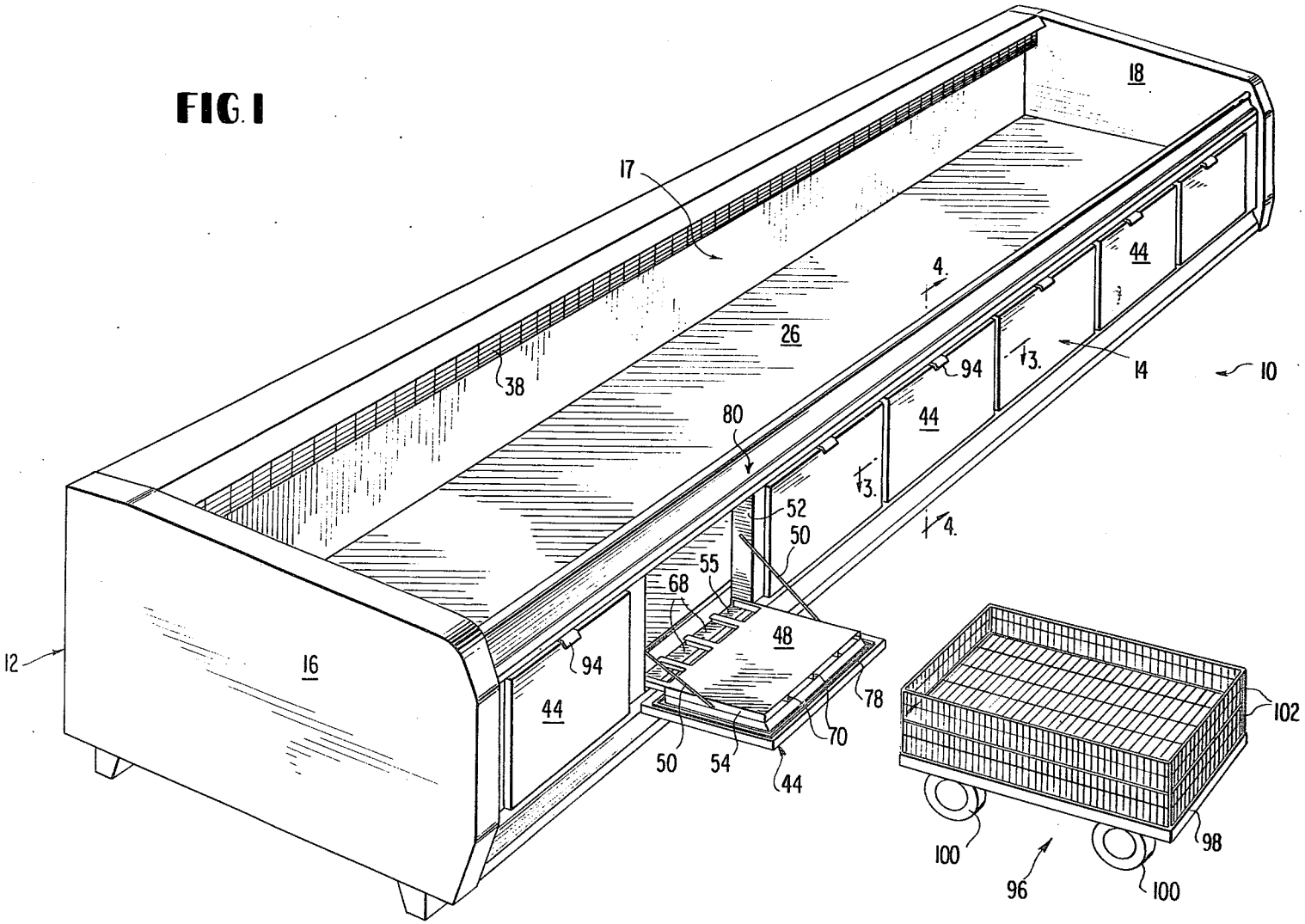
FIG. 1 is a perspective view of the coffin-type freezer with a door in the open position.

Referring now to FIG. 1, the inventive coffin-type freezer case shown by 10 includes a case rear wall 12, a case front wall 14, two case end walls 16, 18, and a case bottom 19 which combine to define among them a well 17 for receiving and refrigerating goods to be displayed. The coffin unit 10 is open entirely along a top portion 20 to provide access and easy viewing of the goods to be displayed for customers in a store where such a freezer is typically found. Between the well 17 and the walls 12, 14, 16, 18, there are air-flow paths 28 to continually refrigerate air moved across top portion of the unit 10. Flow-path 28 is defined between well walls and the aforementioned case walls 12 and front wall 14 of the case 10. More specifically, the well includes well front wall 22 which cooperates with case front wall 14 to form a front duct 30. Similarly, the well bottom wall 26 and case bottom 19 form bottom duct 32 and case rear wall 12 with well rear wall 24 form a rear duct 34. The front duct 30, bottom duct 32 and rear duct 34 are all in fluid communication with one another to form a continuous air flow path.

In the bottom duct 32, there is included in the flow path a fan 36 for drawing air from the top of the front duct 30 through the bottom duct 32, rear duct 34 and forcing air out of a grille 38 at the upper end of the rear duct 34. The grille 38 and the upper end of the front duct 30 are arranged such that air flowing out of the grille 38 will pass across the top portion of the coffin freezer and into another grille 40 provided in the upper end of the front duct 30. Cooling means 42 is provided downstream of the fan in the bottom duct and upstream of the grille 38. The cooling means 42 is any standard refrigeration unit readily available and known to those skilled in the art. In this way, the air being forced across the top portion 20 of the freezer is being cooled constantly.

The case front wall 14 has several doors 44 which pivot outwardly away from the case 10 to expose the well 17 to an area directly in front of the case. These doors 44 are rectangular in configuration and include restraining means for holding the door 44 in a position such that the inner surface 48 is substantially coplanar with that of the well bottom wall 26. To maintain the door 44 in this position, two flexible wire cables 50 are provided on either side of the door 44, each cable 50 having one end secured to stationary jambs 52 in the front of the case with the other ends pivotally secured to side edges 54 of the door.

The bottom portion or sill 55 in the front of the case 10 is provided with spaced lugs 56 along a hinge axis 58, each having a hole 59 therethrough coaxial with the hinge axis 58. The door 44 includes complementary hinge pins 60 for engaging the hole 59 in said lug 56. In this way each door 44 is hingedly secured to the lugs 56 for pivoting about the hinge axis 58 toward and away from the front of the case 10.

Figure 3:
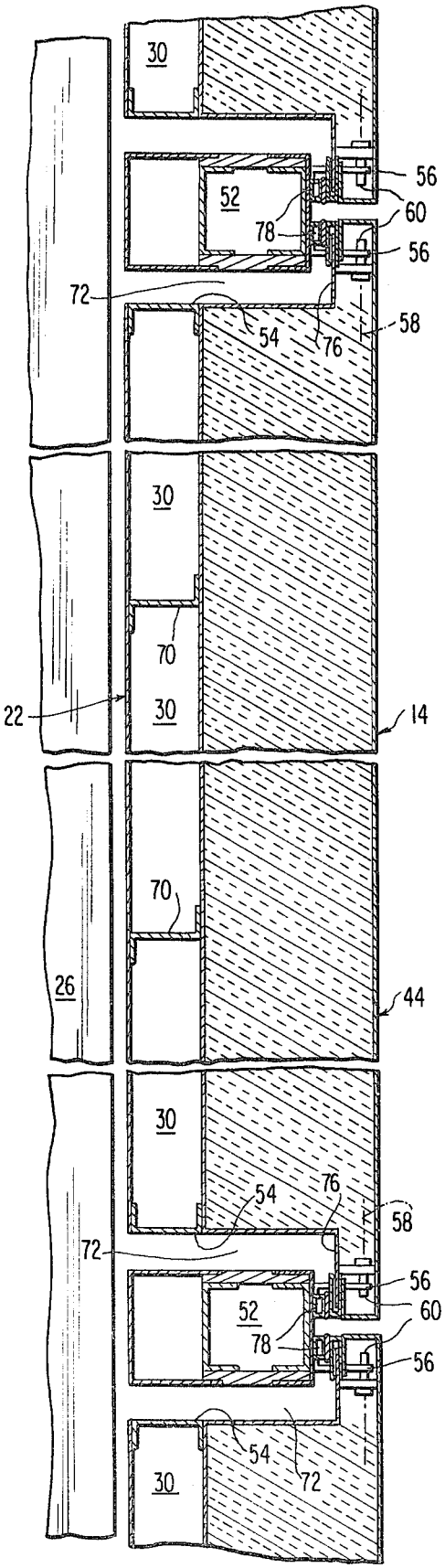
FIG. 3 is a cross-section of a portion of the coffin as shown in FIG. 1, taken along lines 3—3.

The door 44 has a channel 62 along bottom edge 64 thereof for cooperating with a complementary extension 66 on the bottom of the case unit 10. The clearance between the extension 66 and the channel member 62 is such that the door 44 can pivot about the hinge axis 58 without any part of the door 44 interfering with the extension 66. In this way, the door can be sealed in between the channel 62 and the extension 66 in a manner which will be more fully explained later. Further, the front duct 30 a part of which lies in each door 44, extends into the bottom duct as can be seen in FIG. 3. The lower portion of this front duct has openings 68 so that the air flowing through the front duct 30 can readily flow out through these openings 68 into the bottom duct 32. These openings 68 only extend upwardly from the bottom edge 64 a short distance such that when the doors are in the closed position, no part of the openings 68 extend beyond the horizontal plane defined by the well bottom wall 26. In this way substantially none of the air flowing through openings 68 will escape into the well 17 of the freezer.

The entire front duct 30 including the openings 68 has Z-support bars 70 equally spaced extending from the bottom edge 64 to top edge 71 of the door 44. These bars 70 give that part of the front well wall which is also the inner surface 48 of the door 44 sufficient strength to support the goods and materials which will be placed on the door 44 in loading the freezer. With this configuration, the passages through the front duct 30 will not collapse under the weight of the material should they be left on this inner surface 48 of the door 44.

In addition to the channel 62 formed along the bottom edge 64 of the door 44, the remainder of the door 44 defines recess regions 72 in both side edges 54 and in top edge 74. These edges 54, 74 are recessed in a manner which leaves an offset surface 76 entirely around the edges 54, 74 of the door 44 and in channel 62. The offset surface 76 carries a seal 78 for sealing the well 17 of the freezer from the exterior when the door 44 is in a closed position. The seals 78 are permanently secured to these surfaces 76 and configured such that when the door 44 is in the closed position, the portion of the seal 78 on the top edge 74 will engage the top rail 80 of the case 10, the seals 78 on side edges 54 engaging the stationary struts 52 of the case, and the seal along the bottom edge 64 engaging the complementary extension 66. Because these seals 78 are in the recessed region 72, they do not interfere with the loading and unloading of the case. Nor can they be inadvertently pulled out of contact with the door. These seals can be of any elastic material; however, in this preferred embodiment, they are made of hollow rubber having a generally rectangular cross-section configuration as shown.

Figure 4:
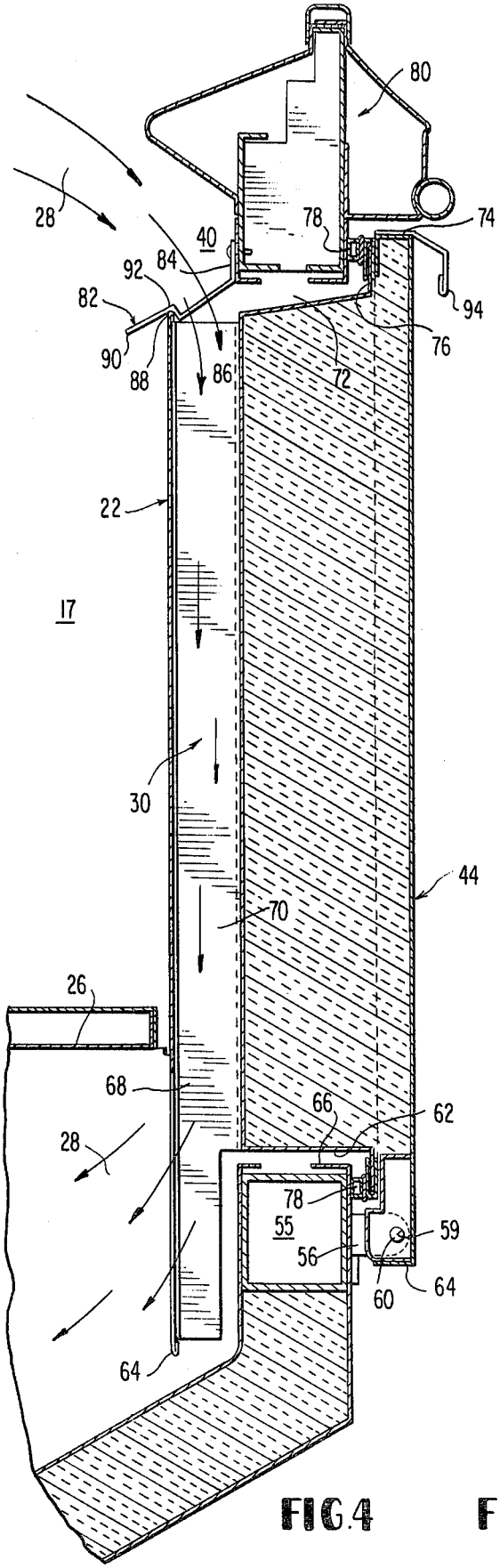
FIG. 4 is a cross-section of a portion of the front wall of the coffin freezer as shown in FIG. 1, taken along lines 4—4.

A spring latch 82 is secured to the rail 80 of the case and interacts with the door 44 to hold the door in a closed position until the operator desires to open the door for loading or unloading. This spring latch 82 is formed from angled metal having a first portion 84 which is secured to the rail 80 of the case and second portion 86 which interacts with lip 88 on the front duct 30 to hold the door 44 in place. The second portion 86 includes a handle 90 which is offset from the second portion to define an angle 92. The handle extends into the well 17 through a gap formed between the grille 38 and lip 88 for access by an operator. As can be seen in FIG. 4, when in the closed position, the angle 92 engages the lip 88 on the front duct 30 which the spring slightly bent so that it will hold the door in place under the resulting spring pressure. When it is desired to open the door 44, the spring is simply moved upwardly by bending the spring 82 out of engagement with the lip 88. A door pull 94 is provided at the top of the door so that the operator can simply grasp the door pull 94 to open the door to a horizontal position. Thus, when it is desired to open the door, the spring 82 simply is to be pulled out of engagement with lip 88 and the door pulled down by door pull 94. Conversely, when closing the door, it simply has to be grasped by the door pull 94 and pushed in the closed position. When the door 44 is moved to the closed position, the spring 82 will simply snap into engagement with the lip to secure the door in place.

Figure 2:
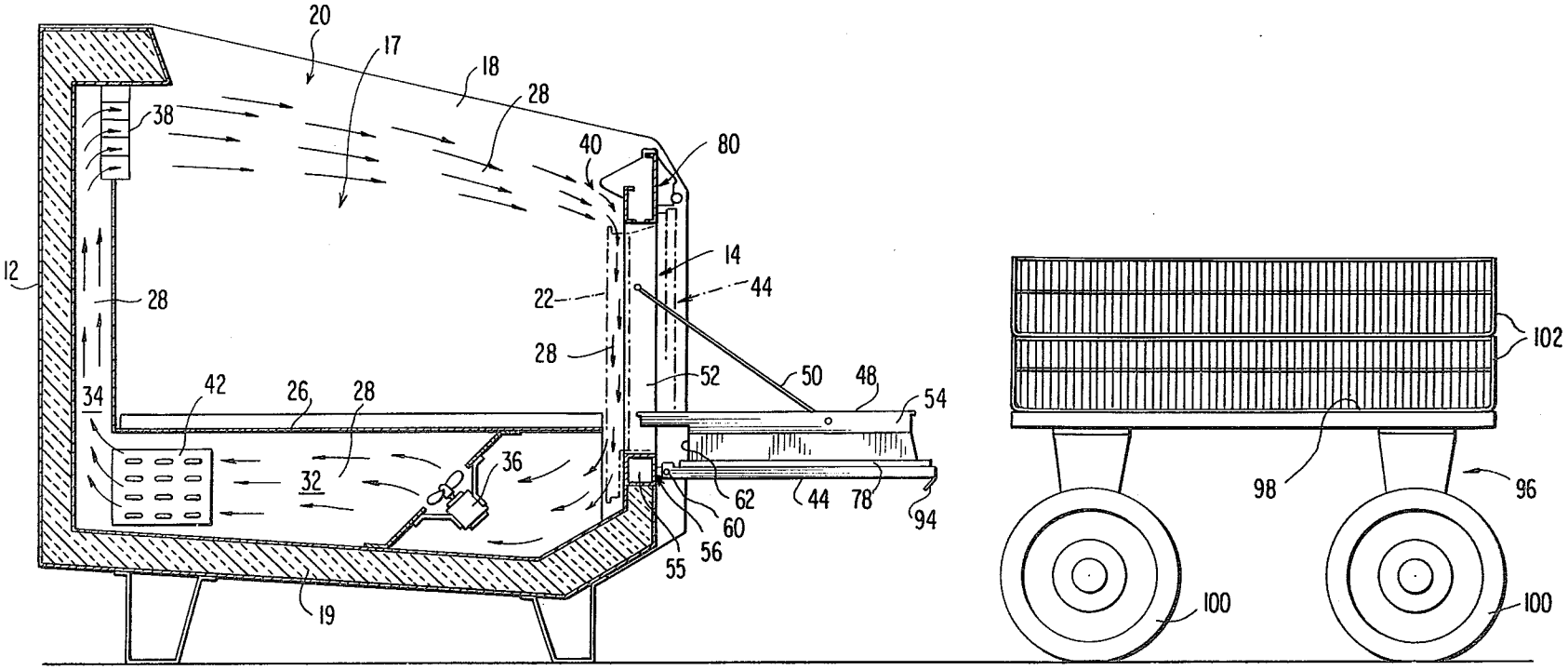
FIG. 2 is a side view of the coffin shown in FIG. 1.

As can be seen in FIG. 2, carts 96 are provided for loading and unloading the case when the doors 44 are in the open position. The cart 96 is characterized by a deck 98 resting on four wheels 100 such that the top surface of the deck 98 is co-planar with the inner surface 48 of the door 44 as well as the well bottom wall 26 when the door 44 is in the open position as shown. Wire racks 102 are carried on the deck 98 of the carts 96 so that they can be slid from the deck 98 onto the door 44 and into the well 17 of the case 10. These wire racks 102 of course carry the goods which are being replaced in the case 10. As a result, they are meant to be slightly less than the dimensions of the door 44 so that they can be readily pushed through the opening resulting when the door 44 is in the open position.

With this configuration, when loading the case, the spring 82 is disengaged from the lip 88 of the front duct 30 and the door 44 is pulled down to the open position as shown in FIG. 2. The cart 96 is then moved into a position adjacent the open door 44 such that it is aligned for moving the wire racks 102 over the inner surface 48 of the door 44 into the well 17 of the case 10. Once the wire racks are located in the proper position within the case, the door 44 is simply pushed to a closed position. In the closed position, the door 44, as explained above, is sealed against jambs and sill of the case 10 so that the air flowing through the front duct 30 will flow in its normal path to the bottom duct 32 and through the remaining portions of the refrigeration system. When unloading the case, the operation is simply reversed. The door 44 is opened and the empty baskets are then pushed out of the well 17 of the freezer 10 across the inner surface of the doors onto the deck 98 of the cart 96. In this way the freezer 10 can be loaded and unloaded in a much more efficient manner than has been characteristic of these types of freezers in the past.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

We claim:

1. A refrigerator case for supporting items therein for display and self-service to customers comprising:

(a) a well portion enclosed by a bottom portion, a front wall, a rear wall, and a top portion, said top portion providing access to items contained in said well portion of the case;

(b) said case including means for refrigerating items contained in said well portion;

(c) said front wall having access means for providing access through said front wall to said well portion to expose said well portion for loading and unloading goods for display, said access means including a panel member hingedly secured to said front wall for movement between an open position for exposing at least a part of said well portion for loading and unloading goods through said front wall and a closed position for closing said front wall, wherein said panel member is generally rectangular in configuration, having a top edge, a bottom edge, a first side edge, and a second side edge, said panel member being hinged along said bottom edge to said front wall for pivotal movement of said panel member downwardly away from said front wall, said panel member further including securing means adjacent said top edge, said front wall having complementary securing means to cooperate with said securing means on said panel member for maintaining said panel member in a closed position and releasing said panel member from said front wall for pivoting said panel member to said open position; and (d) means for restraining the movement of the panel member beyond a predetermined position when said panel member is moved to said open position;

wherein said well portion includes a bottom well wall, a front well wall and a rear well wall, said bottom well wall being generally planar in configuration, said panel member defining an inner surface and an outer surface, said inner surface defining a substantially planar configuration and said restraining means co-operating with a part of said front wall and said panel member to maintain the inner surface of said panel member when in said open position substantially coplanar with the well bottom wall for allowing items to be readily moved on a substantially coplanar surface along the inner surface of said panel into said well portion of the case.

2. The refrigerator case according to claim 1 wherein said restraining means includes at least one flexible cable having one end secured to said part of said front wall and the other end secured to said panel member.

3. The refrigerator case according to claim 2 wherein said well bottom wall and said inner surface of said panel member when said panel member is in said open position and coplanar with said well bottom wall being located a predetermined distance relative to the floor so as to be coplanar with a cart member carrying items for display and refrigeration within said interior portion such that the items can be moved along substantially a single plane defined by the bottom portion, the inner surface of the panel member and the surface of the cart member.

4. The refrigerator case according to claim 3 wherein said front wall includes a top rail member having a sill portion, a bottom rail member having a sash portion and at least two support struts having jams separated from each other extending between said sill portion and said sash portion, said panel member having means along each edge thereof for cooperating with said sill portion, said jams and said sash portions to substantially seal the well portion from surrounding atmosphere along said front wall.

5. The refrigerator case according to claim 4 wherein said front wall includes several support struts with movable panels therebetween for providing access to the well portion of the case at various positions along said front wall.

6. A refrigerator case for supporting items therein for display and self-service to customers comprising:

(a) a well portion enclosed by a bottom portion, a front wall, a rear wall, containing means for holding the goods in the well portion of the case;

(b) said case including means for refrigerating items contained in said well portion; and (c) said front wall having a door means pivotally secured thereto for movement from a closed position which closes said well portion from access through said front wall to an open position which exposes said well portion for access through said front wall to load and unload goods; and (d) release means for cooperating with said door member to hold said door in said closed position until released by said release means allowing said door to be moved to the open position for loading and unloading goods, said release means being automatically re-engaged with said door member when said door is returned to the closed position, wherein said release member includes a spring member configured to engage a portion of said door member, said spring member being a spring latch secured to a rail extending across the top of the refrigerator case, said spring latch being formed from angled metal having a first portion secured to said rail and a second portion interacting with said door member, wherein said door member includes a lip for engagement with said second portion to deform said spring for providing sufficient tension to hold the door in the closed position.

7. The refrigerator case according to claim 6 wherein said portion of said spring member extends sufficiently beyond the well front wall of said well portion for access by an operator whereby the operator can pull said second portion to disengage said angle member from said lip allowing said door member to move to said open position.

8. The refrigerator case according to claim 6 wherein said door member includes a front duct and said bottom portion includes a bottom duct, said front duct and said bottom duct forming part of the refrigeration system, the lower portion of the front duct having openings defining a flow path for air through the front duct out of the openings into said bottom duct, said bottom duct being located beneath the well bottom wall, said openings communicating with said bottom duct and being exposed substantially entirely below the plane of said well bottom wall defining a flow path underneath said well bottom well defining a flow path underneath said well bottom wall whereby a substantial portion of the air is prevented from inadvertently flowing into the well portion.

9. The refrigerator case according to claim 8 wherein said door defines an inner surface, said inner surface being coplanar with the well bottom wall when said door is in an open position, said inner surface forming part of said duct in said front wall, said inner surface being supported by support members for giving the inner surface a sufficient strength to withstand the load of the goods being loaded and unloaded through the door and providing an air flow path through said door when said door is in the closed position.

10. In an open top refrigerated display case having front, rear and side walls defining a storage well, wherein goods to be refrigerated may be stored for display and ready customer access through said open top, the improvement comprising: access means located in said front wall and comprising at least one movable access member hingedly mounted at its bottom to said front wall for pivotal movement outwardly and downwardly into an open position;

an air flow path for directing air to flow around the exterior of said storage well, including bottom duct means extending between the front and rear of the case under the bottom of said well, rear duct means extending upwardly between the rearward portion of said bottom duct means in communication therewith and at least the rear upper extremity of said storage well, and front duct means located on said movable access member and extending between the forward portion of said bottom duct means and at least the front upper extremity of said storage well;

refrigerating means located in said air flow path; and air propulsion means located in said air flow path for propelling air across the open top of said storage well and around the exterior of said storage well through said duct means and said refrigerating means to refrigerate said storage well and goods stored therein.

11. A display case according to claim 10, further comprising:

a substantially planar surface member; and support members for supporting said planar surface member on and in spaced relation with the main body of the movable access member, the space between said planar surface member and the main body of the movable access member defining said front duct means for completing said air flow path when said access member is in a closed position; wherein, in said open position of said movable access member, said planar surface member is substantially coplanar with the bottom of said storage well, said support members providing sufficient strength to said planar surface member to support the weight of goods being loaded into said storage well through said movable access member in its open position.

12. The refrigerator case according to claim 11, wherein the lower portion of the front duct means has openings defining a flow path for air through the front duct means out of the openings into said bottom duct means, said bottom duct means being located beneath the well bottom wall, said openings being exposed substantially entirely below the plane of said well bottom wall and in communication with said bottom duct means and defining a flow path underneath said well bottom wall thereby at least a substantial portion of the air in said flow path is prevented from inadvertently flowing into the well portion.

13. The refrigerator case according to claim 11, wherein when said movable access member is in said open position and coplanar with said well bottom wall, said planar surface member is located a predetermined distance relative to the floor so as to be coplanar with a cart member carrying items for display and refrigeration within said storage well whereby said items can be moved along substantially a single plane defined by said well bottom wall, said inner surface of said panel member and the surface of said cart member.

14. A refrigerator case for supporting items therein for display and self-service to customers comprising:

(a) a well portion enclosed by a bottom portion, a front wall, a rear wall and a top portion, said top portion being open to provide access to items contained in said well portion of the case;

(b) said well portion further defining a well bottom wall, a well front wall, and a well rear wall being displaced from said bottom portion, said front wall, and said rear wall of said case to define an air flow path entirely around said well portion for cooling the items contained therein;

(c) said case further including means for refrigerating the air flowing through said ducts for cooling said well portion;

(d) said front wall having a door member hingedly secured to said front wall for movement from a closed position for closing access through said front wall to said well portion to an open position for providing access through said front wall for loading and unloading said well portion;

(e) said front wall further defining a rail member along said top portion, support struts supporting said rail member from said bottom portion, said rail portion defining a sill, said struts defining jams and said bottom defining a sash for cooperating with said door member to seal said door member from air flow therethrough along the interface between said door member and said sill, said jams and said sash of said front wall;

(f) said refrigerator case further including restraining means for holding said door member at a coplanar disposition with respect to said well bottom wall when said door is in the open position; and (g) said coplanar disposition being coplanar with the deck portion of a cart for readily moving goods on said cart from said deck portion to said inner surface of said door member and into said well portion.

15. The refrigerator case according to claim 14 wherein said rail member further includes a spring latch for engaging said door member to hold said door member in said closed position, said latch being sufficiently exposed for disengaging said door member by an operator allowing said door member to be moved from said closed position to said open position.

* * * * *

UNITED STATES PATENT OFFICE

CERTIFICATE OF CORRECTION

Patent No. 4,161,868 Dated July 24, 1979

Inventor(s) Thomas E. Kennedy and Thomas H. Thompson.

It is certified that error appears in the above-identified patent and that said Letters Patent are hereby corrected as shown below:

Column 1, line 12, "cause" should read --case--.
Column 1, line 26, "usually" should read --unusually--.
Column 2, line 17, change "vertically-shaped" to --vertically-spaced--.
Column 8, line 51, should be deleted in its entirety.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*